US009140516B1

(12) United States Patent
Hyde

(10) Patent No.: US 9,140,516 B1
(45) Date of Patent: Sep. 22, 2015

(54) TRIGGER MECHANISM FOR A CROSSBOW

(71) Applicant: BowTech, Inc., Eugene, OR (US)

(72) Inventor: Tony E. Hyde, Monroe, OR (US)

(73) Assignee: BowTech, Inc., Eugene, OR (US)

( * ) Notice: Subject to any disclaimer, the term of this patent is extended or adjusted under 35 U.S.C. 154(b) by 0 days.

(21) Appl. No.: 14/138,092

(22) Filed: Dec. 22, 2013

Related U.S. Application Data

(62) Division of application No. 13/734,927, filed on Jan. 5, 2013.

(60) Provisional application No. 61/584,190, filed on Jan. 6, 2012.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
USPC ..... 124/25, 35.2, 40
See application file for complete search history.

(56) References Cited

U.S. PATENT DOCUMENTS

| | | | |
|---|---|---|---|
| 5,085,200 | A | 2/1992 | Horton-Corcoran et al. |
| 5,598,829 | A | 2/1997 | Bednar |
| 5,649,520 | A | 7/1997 | Bednar |
| 5,884,614 | A | 3/1999 | Darlington et al. |
| 6,205,990 | B1 | 3/2001 | Adkins |
| 6,736,123 | B1 | 5/2004 | Summers et al. |
| 6,802,304 | B1 | 10/2004 | Chang |
| 7,770,567 | B1 | 8/2010 | Yehle |
| 2006/0144380 | A1 | 7/2006 | Kempf |

OTHER PUBLICATIONS

U.S. Appl. No. 13/734,927, filed Jan. 5, 2013, Hyde.

*Primary Examiner* — John Ricci
(74) *Attorney, Agent, or Firm* — David S. Alavi

(57) ABSTRACT

A trigger assembly for a crossbow comprises a string retainer and a trigger mechanism. The trigger assembly can further comprise a piston, a safety mechanism, a secondary safety mechanism, a bolt sensor, or a pair of rotating sears. The string retainer can comprise a pair of opposed jaws.

11 Claims, 8 Drawing Sheets

TRIGGER MECHANISM FOR A CROSSBOW

BENEFIT CLAIMS TO RELATED APPLICATIONS

This application is a divisional of U.S. non-provisional application Ser. No. 13/734,927 filed Jan. 5, 2013 in the names of Tony E. Hyde and G. Wilson Flint, which in turn claims benefit of U.S. provisional App. No. 61/584,190 filed Jan. 6, 2012 in the names of Tony E. Hyde and G. Wilson Flint, both of said non-provisional and provisional applications being hereby incorporated by reference as if fully set forth herein.

BACKGROUND

The field of the present invention relates to crossbows. In particular, a safety trigger for a crossbow is disclosed herein.

A wide variety of trigger mechanisms are available for crossbows. Some of these are described in:

- U.S. Pat. No. 5,085,200 entitled "Self-actuating, dry-fire prevention safety device for a crossbow" issued Feb. 4, 1992 to Horton-Corcoran et al;
- U.S. Pat. No. 5,598,829 entitled "Crossbow dry fire prevention device" issued Feb. 4, 1997 to Bednar;
- U.S. Pat. No. 5,649,520 entitled "Crossbow trigger mechanism" issued Jul. 22, 1997 to Bednar;
- U.S. Pat. No. 5,884,614 entitled "Crossbow with improved trigger mechanism" issued Mar. 23, 1999 to Darlington et al;
- U.S. Pat. No. 6,205,990 entitled "Dry-fire prevention mechanism for crossbows" issued Mar. 27, 2001 to Adkins;
- U.S. Pat. No. 6,736,123 entitled "Crossbow trigger" issued May 18, 2004 to Summers et al;
- U.S. Pat. No. 6,802,304 entitled "Trigger assembly with a safety device for a crossbow" issued Oct. 12, 2004 to Chang;
- U.S. Pat. Pub. No. 2006/0144380 entitled "Crossbow" published Jul. 6, 2006 in the name of Kempf; and
- U.S. Pat. No. 5,598,829 entitled "Safety trigger for a crossbow" issued Aug. 10, 2011 to Yehle.

SUMMARY

An trigger assembly for a crossbow comprises a string retainer and a trigger mechanism. The trigger assembly can further comprise a piston, a safety mechanism, a secondary safety mechanism, a bolt sensor, or a pair of rotating sears. The string retainer can comprise a pair of opposed jaws.

Objects and advantages pertaining to crossbow triggers may become apparent upon referring to the exemplary embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It should be noted that the embodiments depicted in this disclosure are shown only schematically, and that not all features may be shown in full detail or in proper proportion. Certain features or structures may be exaggerated relative to others for clarity. It should be noted further that the embodiments shown are exemplary only, and should not be construed as limiting the scope of the written description or appended claims.

DETAILED DESCRIPTION OF EMBODIMENTS

Figure 4:
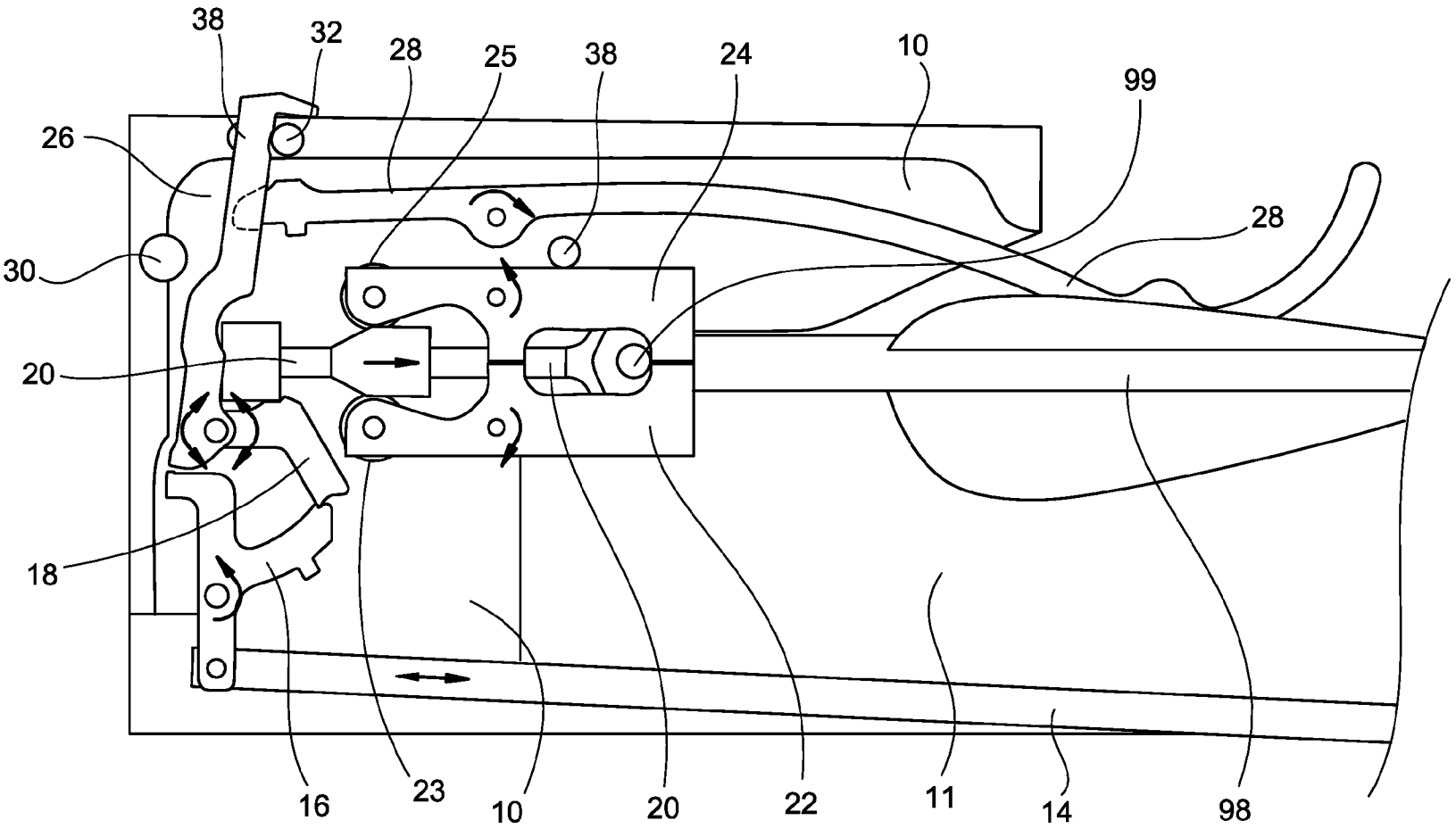
FIG. 4 is an enlarged schematic side view of the crossbow trigger assembly of FIG. 1 after releasing the safety.
Figure 5:
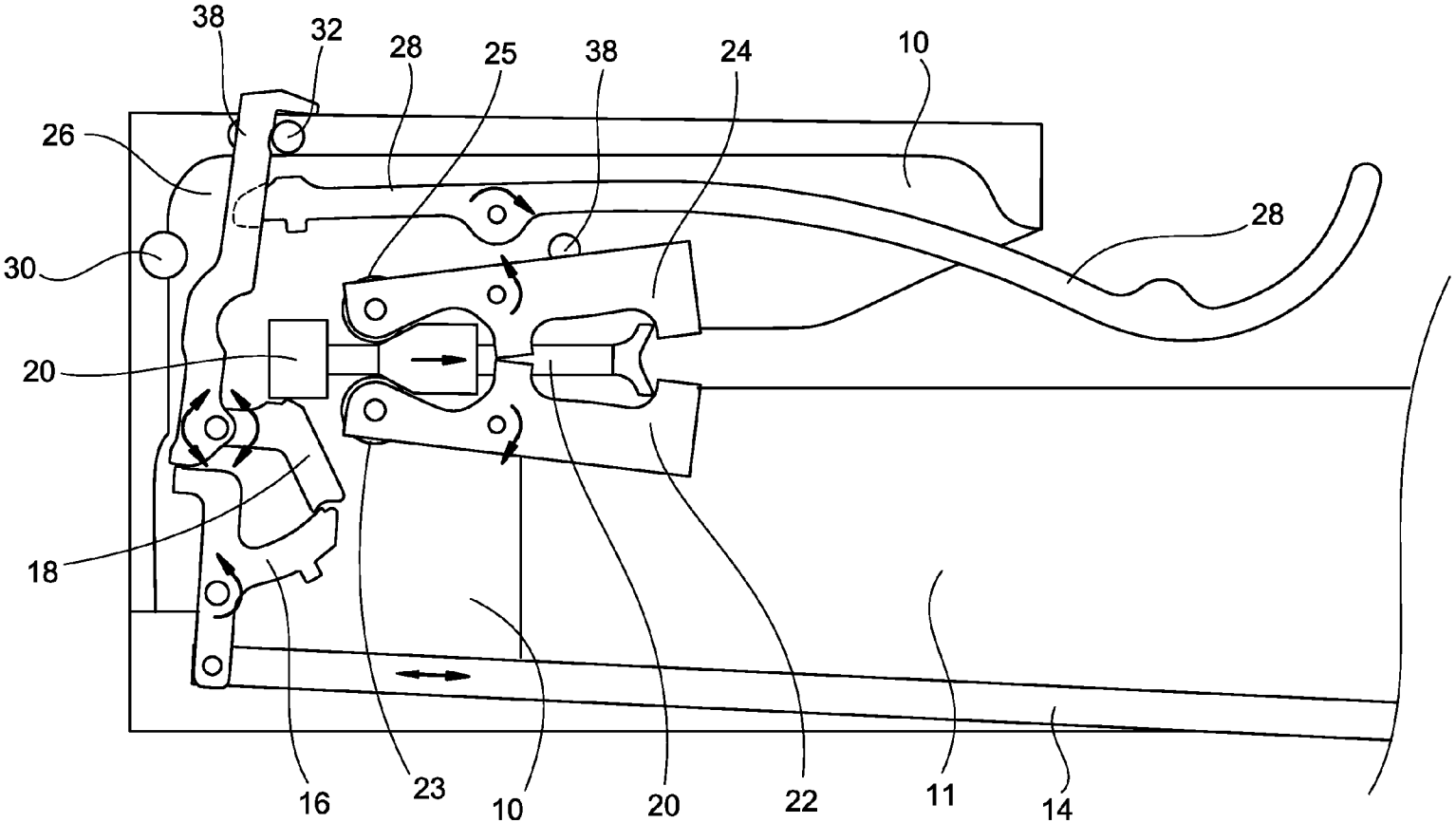
FIG. 5 is an enlarged schematic side view of the crossbow trigger assembly of FIG. 1 after triggering the crossbow.
Figure 6:
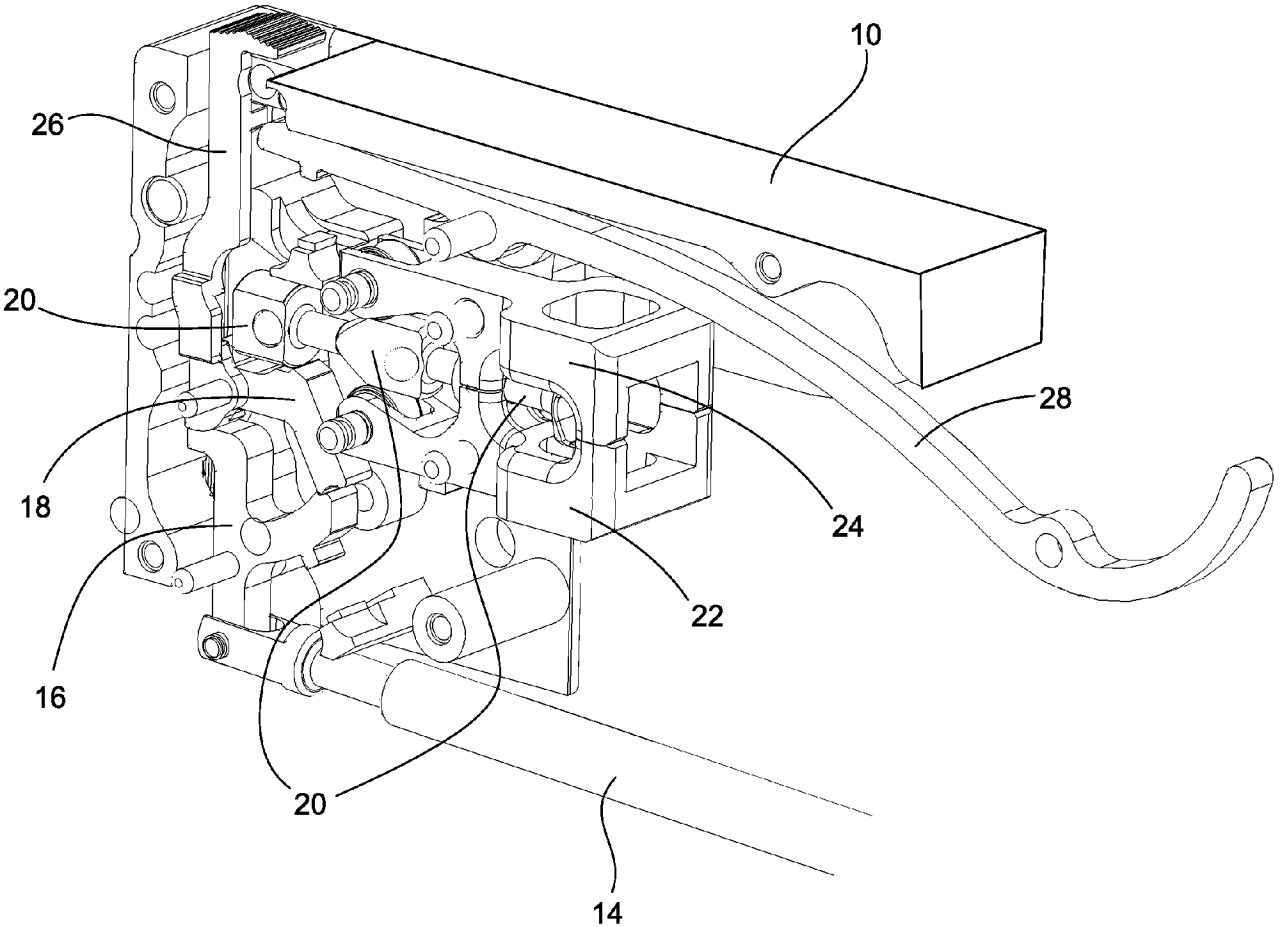
FIG. 6 is an enlarged schematic perspective view of the crossbow trigger assembly of FIG. 1 prior to placement of a bolt.

FIGS. 1-6 illustrate schematically a crossbow trigger assembly. The trigger assembly typically is mostly contained within a trigger housing 10. The trigger housing 10 can comprise an opening or cavity formed in the stock or rail 11 of the crossbow (not shown) or can comprise a discrete housing 10 that is in turn secured to the stock or rail 11 of the crossbow. Both arrangements are encompassed by the present disclosure. The crossbow is not shown and can be of any suitable type or configuration. In the Drawings the trigger assembly is shown with one side of the housing 10 removed to reveal the trigger mechanism within. The entire trigger assembly is illustrated schematically in FIG. 1, while FIGS. 2-6 are enlarged schematic views of that portion of the trigger assembly contained within the trigger housing 10. The side views of FIGS. 2-5 illustrate schematically the firing sequence of the trigger assembly, and FIG. 6 is a perspective view corresponding to FIG. 2. FIGS. 7A-7D illustrate schematically a secondary safety mechanism.

In FIGS. 2-5, the heavy arrows indicate the movements of the various parts of the trigger assembly. Single-headed arrows indicate that the designated motion is permitted in both directions but is directly biased in the direction of the single arrowhead. Directly biased means that a suitable bias mechanism (including for example a torsion spring, linear spring, some other resilient member, a weight, an actuator, or some other suitable biasing element or means) is arranged to act directly on that part. Biasing elements such as springs are omitted from the Drawings for clarity. Double-headed arrows indicate that the designated motion of the corresponding part is permitted in both directions and is not directly biased in either direction. However, the non-biased part can be indirectly biased by bias or movement of other adjacent parts.

In the Detailed Description, various disclosed or claimed features are grouped together in a single disclosed exemplary embodiment for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of the single disclosed exemplary embodiment. Thus, the appended claims are hereby incorporated into the Detailed Description, with each claim standing on its own as a separate disclosed exemplary embodiment. However, the present disclosure shall also be construed as implicitly disclosing any embodiment having any suitable set of one or more disclosed or claimed features (i.e., sets of features that are not incompatible or mutually exclusive) that appear in the present disclosure or the appended claims, including those sets that may not be explicitly disclosed herein. It should be further noted that the scope of the appended claims does not necessarily encompass the whole of the subject matter disclosed herein.

A trigger assembly for a crossbow comprises a string retainer and a trigger mechanism. The trigger assembly can further comprise a piston, a safety mechanism, a secondary safety mechanism, a bolt sensor, or a pair of rotating sears.

The string retainer is moveable between a firing retainer position and a non-firing retainer position. The retainer is (i) arranged in the non-firing retainer position to retain a drawn bowstring 99 of the crossbow and (ii) arranged in the firing retainer position to release the bowstring 99. In the exemplary embodiment the string retainer comprises a lower jaw 22 and an upper jaw 24. Each jaw 22/24 is pivotably moveable, about a corresponding jaw pivot point between forward and rearward portions of the jaw, between a closed non-firing jaw position (as in FIGS. 1-4, 6, and 7A) and an open firing jaw position (as in FIG. 5). The forward portions of the jaws 22/24 are arranged to retain the bowstring 99 with the jaws 22/24 in their respective closed non-firing jaw positions. With the jaws 22/24 in their respective open firing positions, the bowstring 99 is released and the crossbow fires. The jaws 22/24 can be biased toward their open firing jaw positions as indicated in the Drawings.

Although a pair of jaws 22/24 is shown in the exemplary embodiment, a single retainer can be employed in other embodiments. A pair of jaws can be advantageous, e.g., for reducing the effects of wax or ice buildup on the retainer causing the bowstring to stick to the retainer, or for reducing the movement needed to release the bowstring (i.e., half a string width versus a full string width). "Jaws" and "retainer" are used somewhat interchangeably herein. Although pivoting jaws 22/24 are shown in the exemplary embodiment, a string retainer exhibiting any suitable movement between non-firing and firing positions can be employed in other embodiments, e.g., pivoting, rotary, or reciprocating (i.e., linear). In any of those examples, the retainer can be biased toward its firing position.

A trigger mechanism is moveable between a non-firing trigger arrangement (as in FIGS. 1-4, 6, and 7A) and a firing trigger arrangement (as in FIG. 5). The trigger mechanism is (i) arranged in the non-firing trigger arrangement to hold the retainer (e.g., jaws 22/24) in the non-firing retainer position and (ii) arranged in the firing trigger arrangement to enable the retainer to move to the retainer firing position. Any suitable trigger mechanism can be employed comprising any structure, linkage, or mechanism. The trigger mechanism can be biased toward its non-firing trigger arrangement. In the exemplary embodiment, a bullpup trigger arrangement is shown that comprises a trigger rod 14 coupling a trigger 12 to a first rotating sear 16. The trigger mechanism can further include a second rotating sear 18 coupled to the first sear 16 and to the bowstring retainer (e.g., jaws 22/24). Other suitable arrangements can be employed, e.g., the trigger 12 can be rigidly connected to the first sear 16.

The trigger mechanism can further include a piston 20 that is reciprocally moveable between a non-firing piston position (as in FIGS. 1-4, 6, and 7A) and a firing piston position (as in FIG. 5). The trigger mechanism is (i) arranged in the non-firing trigger arrangement to hold the piston 20 in the non-firing piston position and (ii) arranged in the firing trigger arrangement to enable the piston 20 to move to the firing piston position. The piston 20 in turn is (i) arranged in the non-firing piston position to hold the retainer (e.g., jaws 22/24) in the non-firing retainer position and (ii) arranged in the firing piston position to enable the retainer to move to the firing retainer position. The piston 20 can be biased toward its firing piston position as indicated in the Drawings.

The trigger mechanism can be arranged so that reciprocating motion of the piston 20 is in a fore-and-aft direction relative to the crossbow. The piston 20 can be further arranged so that backward movement of the bowstring 99 into a position to be retained by the retainer (e.g., jaws 22/24) urges the bowstring 99 backward against a forward portion of the piston 20 and causes backward movement of the piston 20 to the non-firing piston position. The piston 20 is thereby urged against the retainer and causes movement of the retainer to the non-firing retainer position to retain the bowstring 99. That sequence occurs when a user draws the crossbow and pulls the bowstring 99 into the trigger assembly to be captured by the retainer, thereby cocking the bow so it can be loaded and fired.

The trigger assembly can be arranged so that, with the retainer 22/24 and the piston 20 in their respective non-firing positions (as in FIGS. 1-4, 6, and 7A), a direction of force exerted by the piston 20 on the retainer 22/24 is within about ±10° of perpendicular to a direction of reciprocal movement of the piston 20. The direction of that force can be substantially perpendicular to the direction of reciprocal movement of the piston 20. With the forces between the retainer 22/24 and the piston nearly perpendicular to the piston motion, force transmitted from the drawn bowstring 99 through the retainer 22/24 to the piston 20 does not directly oppose its reciprocal movement. Rolling bearings 23 and 25 are typically required at the points of contact between the jaws 22/24 and the piston 20 to further decouple the piston 20 by reducing friction between the piston 20 and the jaws 22/24.

The piston 20 can be arranged with first and second segments arranged along the direction of its reciprocal movement. The first segment has a larger width transverse to the direction of reciprocal piston movement than does the second segment. With the retainer 22/24 and the piston 20 in their respective non-firing positions, the first, wider segment of the piston 20 is positioned against the retainer 22/24 to hold it in its non-firing position. With the retainer 22/24 and the piston 20 in their respective firing positions, the second, narrower segment of the piston 20 is positioned against the retainer 22/24, allowing the retainer 22/24 to move toward its firing position. A tapered segment of the piston can connect the first, wider segment and second, narrower segment. The piston 20, retainer 22/24, and rolling bearings 23/25 are arranged so that the rolling bearings 23/25 roll from the first segment of the piston 20 along the tapered segment to the second segment as the piston 20 moves from the non-firing piston position to the firing piston position.

In the exemplary embodiment, the first, wider segment of the piston is positioned between the rearward portions of the jaws 22/24 when the piston and jaws 22/24 are in their non-firing positions. With the jaws 22/24 and the piston 20 in their respective firing positions, the second, narrower segment of the piston 20 is positioned between the rearward portions of the jaws 22/24. The rearward portions of the jaws 22/24 can be biased toward one another, thereby biasing the jaws 22/24 toward their respective open firing jaw positions.

The trigger assembly can further include a safety mechanism 26 moveable between a safety-off arrangement and a safety-on arrangement. The safety mechanism 26 is (i) arranged in the safety-on arrangement so as to block movement of the trigger mechanism into the firing trigger arrangement (as in FIGS. 1-3, 6, and 7A) and (ii) arranged in the safety-off arrangement so as to allow movement of the trigger mechanism into the firing trigger arrangement (as in FIGS. 4 and 5). The trigger assembly can further include a bolt sensor 28 moveable between a bolt-present position and a bolt-absent position and biased toward the bolt-absent position. The bolt sensor 28 can be arranged to remain in its bolt-absent position in response to its bias in the absence of a bolt 98 loaded onto the crossbow rail 11 (as in FIGS. 1, 2, 6, and 7A) and to be held in its bolt-present position against its bias by a bolt 98 loaded onto the crossbow rail 11 (as in FIGS. 3 and 4). The bolt sensor 28 can be arranged in its bolt-absent position to block movement of the safety mechanism 26 toward its safety-off arrangement and arranged in its bolt-present position to allow substantially unrestricted movement of the safety mechanism 26 into its safety-off arrangement.

The trigger assembly can further include one or more magnets for holding the safety mechanism 26 in one or more desired positions. One magnet 30 can be arranged (i) to retain the safety mechanism 26 in the safety-on arrangement (in the absence of sufficient force applied by a user to the safety mechanism) and (ii) to allow movement of the safety mechanism into the safety-off arrangement (in response to sufficient force applied by a user to the safety mechanism). Another magnet 32 can be arranged (i) to retain the safety mechanism in the safety-off arrangement (in the absence of sufficient force applied by a user to the safety mechanism) and (ii) to allow movement of the safety mechanism into the safety-on arrangement (in response to sufficient force applied to the safety mechanism). "Sufficient force" can be subjectively determined so that, e.g., the safety is not often inadvertently moved to the safety-off by normal use or handling of the crossbow, but can be intentionally moved without undue force being required (e.g., can be moved by hand without struggle, pain, or injury). The magnets tend to make less noise than other mechanisms serving similar purposes, such as detent mechanisms or over-center mechanisms. Noise reduction can be important in certain circumstances, such as when the crossbow is used for hunting.

Figure 7A:
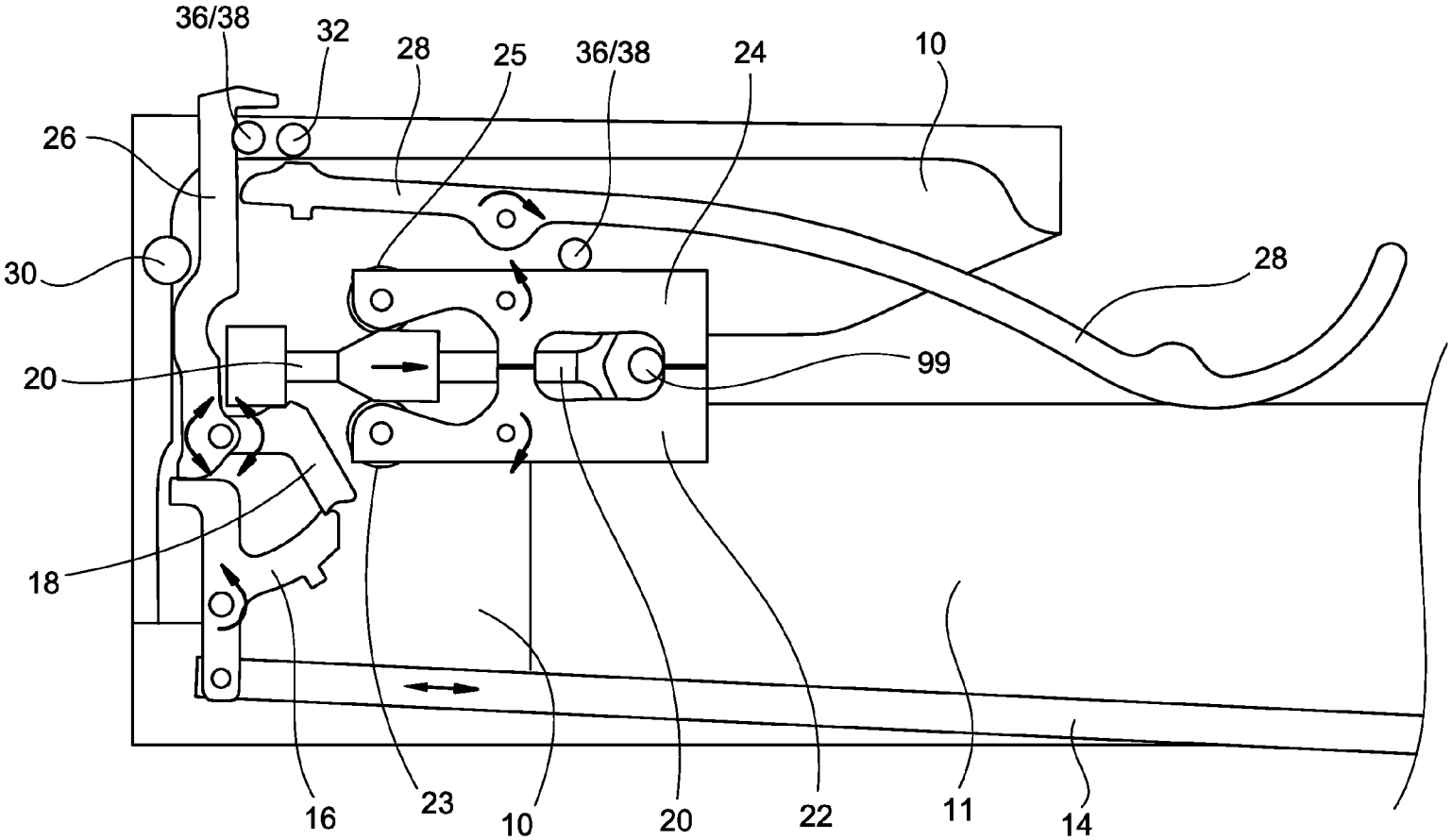
FIG. 7A is an enlarged schematic side view of the crossbow trigger assembly of FIG. 1 with a secondary safety mechanism prior to placement of a bolt.

The trigger assembly can further include a removable secondary safety mechanism 34 arranged to be coupled to the trigger assembly in a secondary safety-on arrangement (as in FIG. 7A). In that secondary safety-on arrangement, the secondary safety mechanism 34 is arranged (i) so as to block movement of the primary safety mechanism 26 from the primary safety-on arrangement to the primary safety-off arrangement or (ii) so as to block movement of the retainer 22/24 from the non-firing retainer position to the firing retainer position. The secondary safety mechanism 34 can comprise one or more pins or rods 36 removably inserted into suitably located holes 38 in housing 10 (FIG. 7A). The rods or pins 36 thus positioned (i) block movement of the primary safety mechanism 26 from its safety-on arrangement to its safety-off arrangement, (ii) block movement of the retainer 22/24 from the non-firing retainer position to the firing retainer position, or (iii) both. A coupler 40 can connect multiple pins or rods 36 (as in FIGS. 7B-7D). The secondary safety mechanism 34 can be engaged after the crossbow has been drawn and elements of the trigger assembly are in their non-firing positions, to ensure that the crossbow does not accidentally fire while the user loads the bolt 98. After the bolt 98 is loaded, the secondary safety mechanism 34 can be removed. When the user is ready to fire the crossbow, the primary safety mechanism 26 can be moved to its safety-off position and the crossbow can be fired by pulling the trigger 12. The secondary safety mechanism 34 provides an extra measure of safety during the bolt-loading process, which is typically recognized as one of the most dangerous actions performed by a user of the crossbow.

Figure 7D:
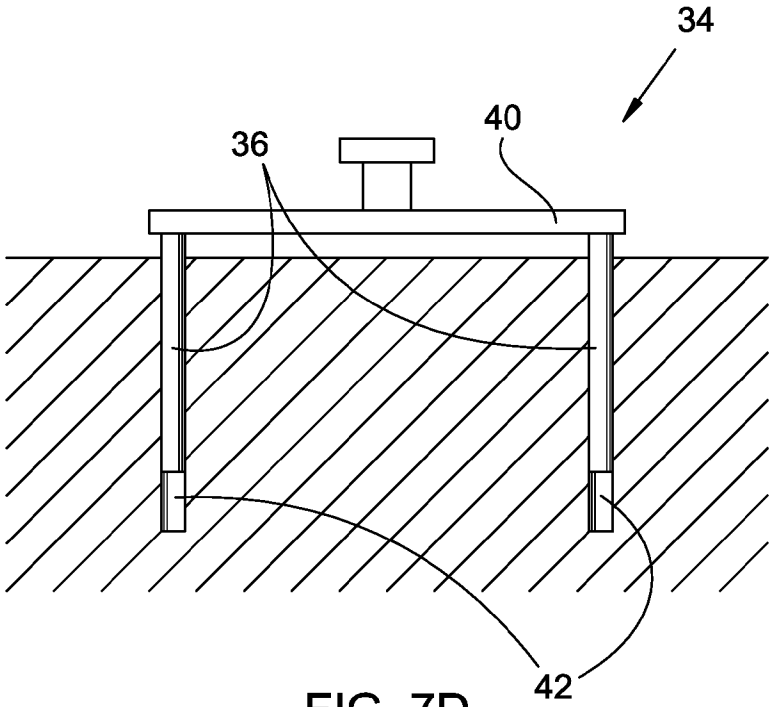
FIG. 7D illustrates schematically storage of the secondary safety mechanism on a crossbow.
Figure 7B:
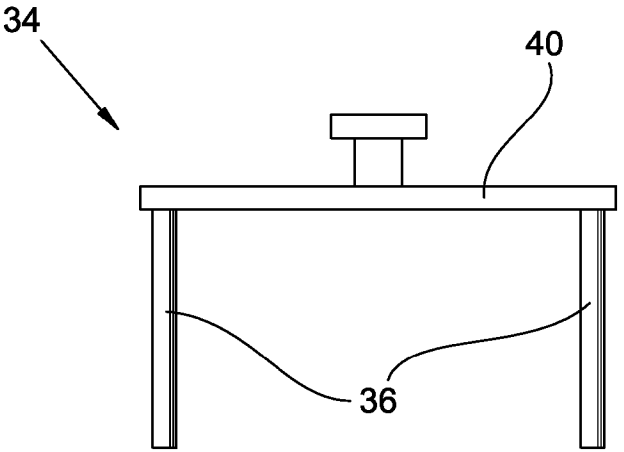
FIGS. 7B and 7C are isolated views of the secondary safety mechanism.
Figure 7C:
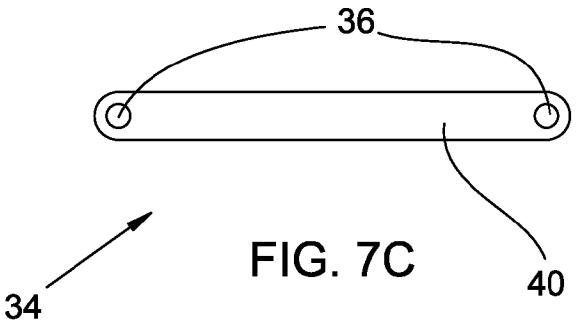

To prevent loss of the secondary safety mechanism 34 when it is removed from the trigger assembly, the crossbow can be provided with a set of "storage" holes 42 arranged to removably receive and retain the pins or rods 36 (as in FIG. 7D). Such storage holes 42 can be placed in any convenient location on the crossbow. A common location is on the stock of the crossbow. The storage holes 42 can be arranged in any suitable way to retain the rods or pins 36, e.g., by receiving the pins or rods 36 with a friction fit. When needed again, the user can readily locate the secondary safety mechanism 34, remove it from the storage holes 42, and place it in its secondary safety-on arrangement in holes 38. Alternatively, the secondary safety mechanism 34 can be attached to the crossbow with a flexible tether (e.g., cord, cable, string, and so on) sufficiently long so as to enable the secondary safety mechanism 34 to be placed in the secondary safety-on arrangement.

Figure 1:
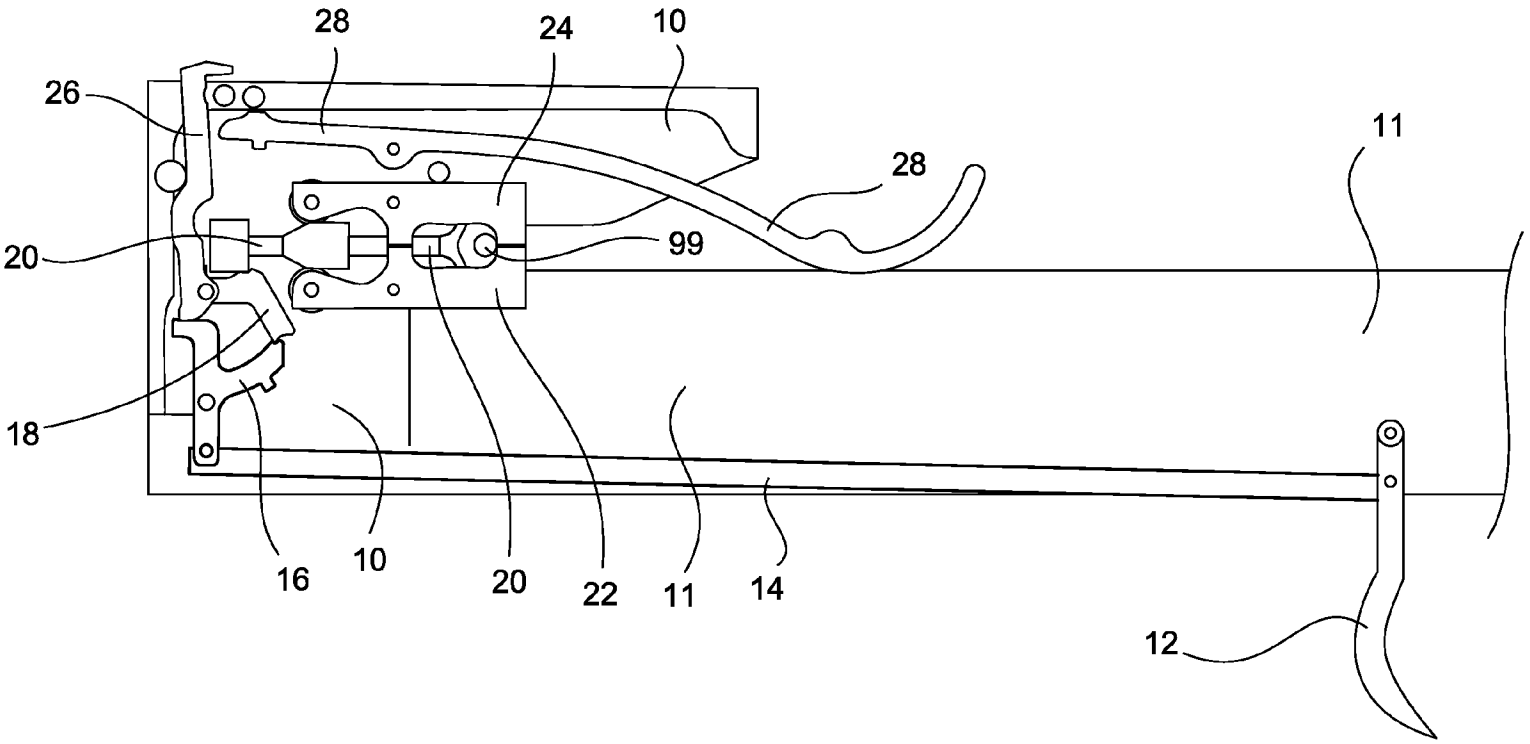
FIG. 1 is a schematic side view of a crossbow trigger assembly.
Figure 2:
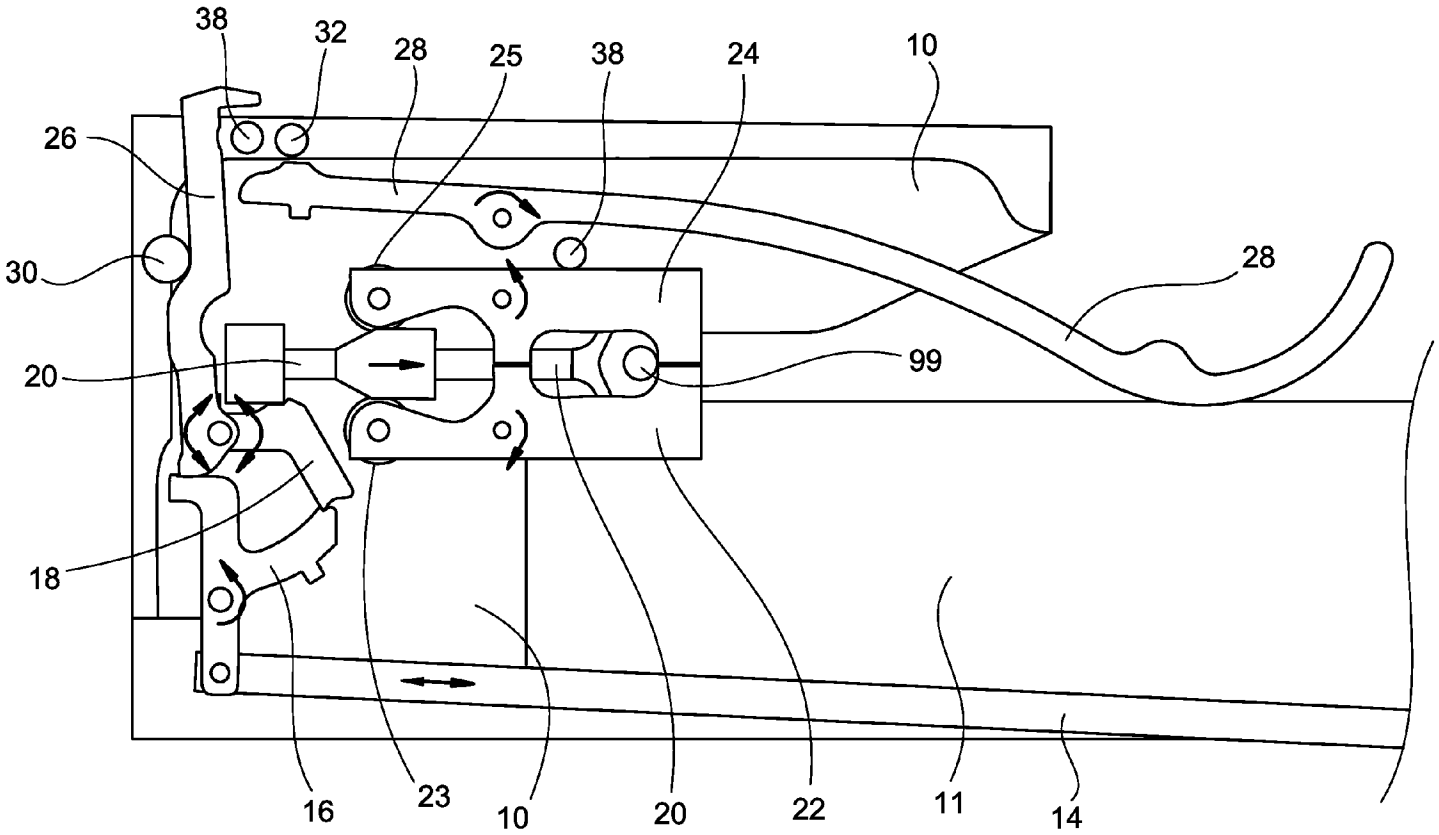
FIG. 2 is an enlarged schematic side view of the crossbow trigger assembly of FIG. 1.

The trigger assembly is shown in FIG. 2 after the crossbow has been drawn but before a bolt 98 (i.e., an arrow) has been loaded onto the crossbow for firing. Jaws 22/24 hold the bow string 99 in the drawn position; piston 20 holds the jaws 22/24 in their closed, non-firing positions; sear 18 holds piston 20 in its non-firing position; sear 16 holds sear 18 in its non-firing position; sear 16 is biased toward its non-firing position and held there by safety lever 26. Once the crossbow is drawn, the archer would push safety mechanism 26 forward to its safety-off position to enable movement of the rotatable sear 16. However, the rearward end of bolt sensor 28 blocks the rotation of safety mechanism 26 to the safety-off arrangement or position when no bolt 98 is present. Rotation of bolt sensor 28 about its axis is biased so that its forward portion is urged downward and its rearward end is positioned to block movement of safety mechanism 26 toward its safety-off arrangement when no bolt 98 is present (i.e., the bolt-absent position of bolt sensor 28). Magnet 30 is positioned to retain the safety mechanism 26 in the safety-on position when the bolt sensor 28 blocks its movement. Safety mechanism 26 therefore cannot be moved into its safety-off position unless a bolt 98 is loaded onto the crossbow for firing, thereby reducing the likelihood of so-called "dry-firing" of the crossbow. Such dry firing can result in damage to the crossbow or injury to the archer.

Figure 3:
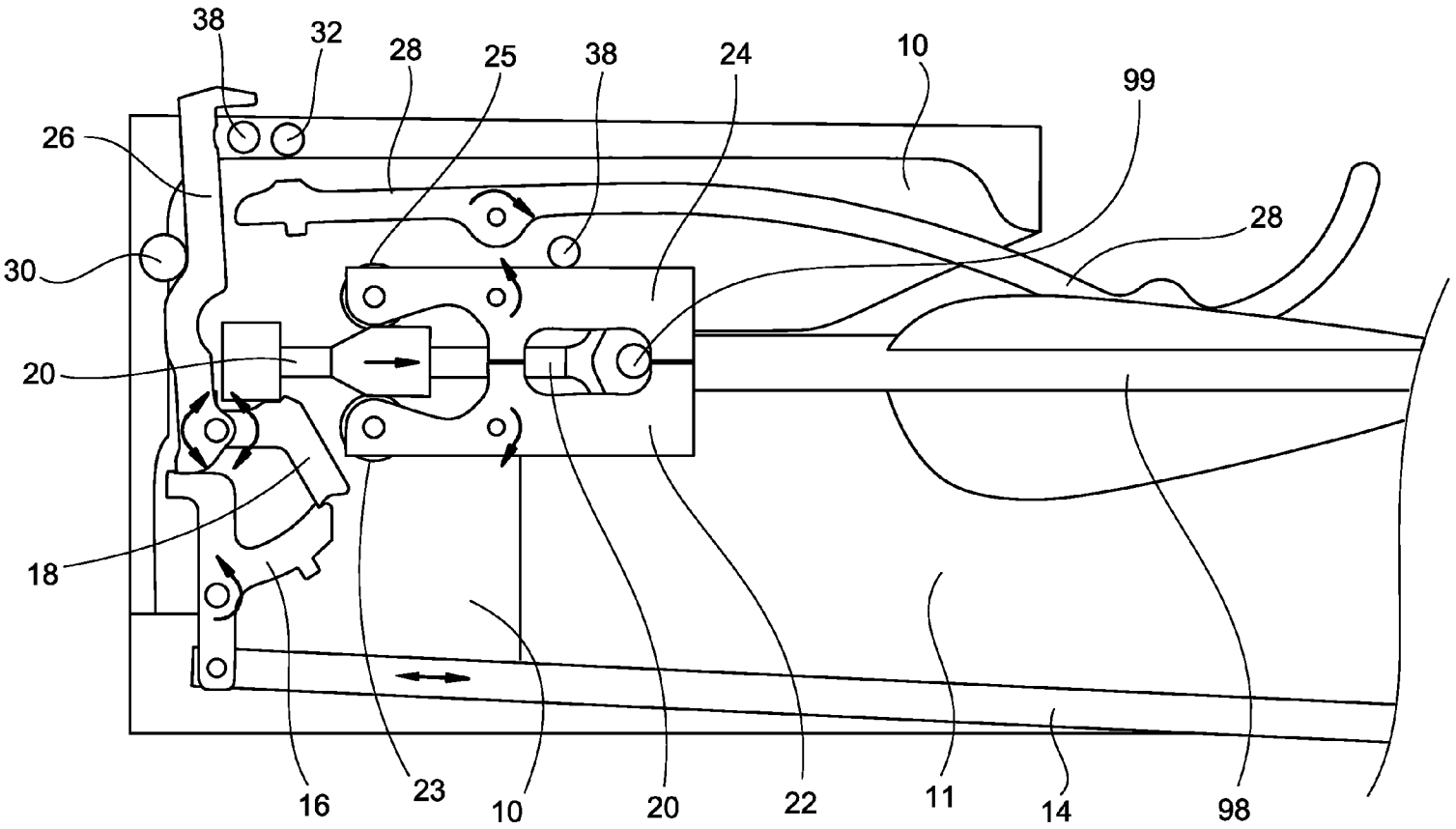
FIG. 3 is an enlarged schematic side view of the crossbow trigger assembly of FIG. 1 after placement of a bolt.

In FIG. 3, a bolt 98 has been loaded onto the crossbow for firing. The nock end of the bolt is positioned against the bowstring 99 between forward projections of jaws 22/24 and under the forward portion of bolt sensor 28. The shaft of the bolt 98 forces the front end of bolt sensor 28 upward, rotating it about its axis to its bolt-present position and causing its rear end to move downward, where it does not block movement of safety mechanism 26 (by virtue of a suitably placed recess in the safety lever 26, as shown in FIGS. 4 and 5; other suitable arrangements can be employed). The rotation of bolt sensor 28 into this bolt-present position therefore enables movement of safety lever 26 to its safety-off position. Although bolt sensor 28 is shown in the exemplary embodiment, any suitable structure, linkage, or mechanism can be employed as a bolt sensor to block movement of the safety mechanism 26 in a bolt-absent arrangement and allow movement of the safety mechanism 26 in a bolt-present arrangement; neither the present disclosure nor the appended claims are limited to the specific arrangement shown in the Drawings unless specifically stated. While safety lever 26 is in its safety-on position, it blocks rotation of sear 16 from its non-firing position and therefore prevents accidental firing of the crossbow. When ready to fire and with bolt 98 loaded onto the crossbow, the archer can move safety lever 26 forward to its safety-off position (disengaging it from magnet 30; FIG. 4); in that position the safety lever 26 no longer blocks rotation of sear 16 (FIG. 4). Magnet 32 is positioned to retain the safety mechanism 26 in the safety-off position when moved there by the archer. The crossbow trigger assembly is ready for firing.

It should be noted that at this stage (FIG. 4, bolt loaded, safety off, and ready for firing), removal of bolt 98 from the crossbow results in reengagement of the safety mechanism 26. If bolt 98 is removed (and its presence no longer prevents downward movement of the front end of bolt sensor 28), the bias on bolt sensor 28 causes its front end to rotate upward; its rear end and a mating recessed portion of the safety lever 26 can be angled (FIGS. 4 and 5) so that the rotation of bolt sensor 28 toward its bolt-absent position forces movement of the safety lever 26 to its safety-on position (disengaging the safety lever 26 from magnet 32 and reengaging it with magnet 30). Other suitable arrangements can be employed. Likewise, if the archer simply changes his/her mind, the safety lever 26 can be readily disengaged from magnet 32 and moved back to its safety-on position, where it is retained by magnet 30.

FIG. 5 shows the trigger assembly after firing the crossbow. Pulling the trigger 12 causes the sear 16 to rotate against its bias toward its firing position, which in turn causes sear 18 to rotate toward its firing position. That rotation of sear 18 allows piston 20 to move to the firing piston position in response to its bias, which in turn enables the jaws 22/24 to move to their open, firing positions in response to their bias. That movement of jaws 22/24 releases the bowstring 99 and fires the bolt 98 (both missing from FIG. 5 since the crossbow has been fired). The archer can then pull the bowstring to draw the crossbow, returning it to the arrangement of FIGS. 1 and 2.

Although specific arrangements are shown in the exemplary embodiment, any suitable structures, linkages, or mechanisms can be employed to perform the function recited herein; neither the present disclosure nor the appended claims are limited to the specific arrangements or embodiments shown in the Drawings. It is intended that equivalents of the disclosed exemplary embodiments and methods shall fall within the scope of the present disclosure or appended claims. For example, some parts that are shown in the exemplary embodiment as rotating can move linearly in alternative embodiments, and vice versa, unless the specific type of movement is specified in a given claim. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶6 are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A trigger assembly for a crossbow, the trigger assembly comprising:

(a) a string retainer moveable between a firing retainer position and a non-firing retainer position, wherein the retainer is (i) arranged in the non-firing retainer position to retain a drawn bowstring of the crossbow and (ii) arranged in the firing retainer position to release the bowstring; and (b) a trigger mechanism moveable between a firing trigger arrangement and a non-firing trigger arrangement, wherein the trigger mechanism is (i) arranged in the non-firing trigger arrangement to hold the retainer in the non-firing retainer position and (ii) arranged in the firing trigger arrangement to enable the retainer to move to the retainer firing position, wherein:

(c) the trigger mechanism includes first and second rotating sears;

(d) the first sear is (i) coupled to a trigger of the crossbow, (ii) arranged in the non-firing trigger arrangement to block rotation of the second sear, and (iii) arranged in the firing trigger arrangement to allow rotation of the second sear to the firing trigger arrangement;

(e) the second sear is (i) arranged in the non-firing trigger arrangement to block movement of the retainer from the non-firing retainer position and (ii) arranged in the firing trigger arrangement to allow movement of the retainer to the firing retainer position.

2. The trigger assembly of claim 1 further comprising a bullpup trigger coupled to the first sear.

3. The trigger assembly of claim 1 wherein:

the trigger mechanism further includes a piston reciprocally moveable between a firing piston position and a non-firing piston position;

the piston is (i) arranged in the non-firing piston position to hold the retainer in the non-firing retainer position and (ii) arranged in the firing piston position to enable the retainer to move to the firing retainer position; and the second sear is (i) arranged in the non-firing trigger arrangement to block movement of the piston from the non-firing piston position and (ii) arranged in the firing trigger arrangement to allow movement of the piston to the firing piston position.

4. The trigger assembly of claim 3 wherein:

the retainer is biased toward the firing retainer position;

the piston is (i) arranged in the non-firing piston position to hold the retainer in the non-firing retainer position against a retainer bias and (ii) arranged in the firing piston position to enable the retainer to move to the firing retainer position in response to the retainer bias;

the piston is biased toward the firing piston position;

the second sear is (i) arranged in the non-firing trigger arrangement to hold the piston in the non-firing piston position against the piston bias and (ii) arranged in the firing trigger arrangement to enable the piston to move to the piston firing position in response to the piston bias; and the first sear is biased toward the non-firing trigger arrangement.

5. The trigger assembly of claim 4 wherein (i) reciprocating motion of the piston is in a fore-and-aft direction relative to the crossbow, and (ii) the piston is arranged so that backward movement of the bowstring into a position to be retained by the retainer urges the bowstring backward against a forward portion of the piston and causes backward movement of the piston to the non-firing piston position, thereby urging the piston against the retainer and causing movement of the retainer to the non-firing retainer position to retain the bowstring.

6. The trigger assembly of claim 1 wherein:

the retainer comprises first and second jaws;

each jaw is pivotably moveable, about a corresponding jaw pivot point between forward and rearward portions of the jaw, between a closed non-firing jaw position and an open firing jaw position; and the forward portions of the jaws are arranged to retain the bowstring with the jaws in their respective closed non-firing jaw positions.

7. The trigger assembly of claim 6 wherein:

the trigger mechanism includes a piston reciprocally moveable between a firing piston position and a non-firing piston position;

the piston is (i) arranged in the non-firing piston position to hold the jaws in the corresponding closed non-firing jaw position and (ii) arranged in the firing piston position to enable the jaws to move to the corresponding open firing jaw positions;

with the jaws and the piston in their respective non-firing positions, a first, wider segment of the piston is positioned between the rearward portions of the jaws; and with the jaws and the piston in their respective firing positions, a second, narrower segment of the piston is positioned between the rearward portions of the jaws.

8. The trigger assembly of claim 7 wherein:

the jaws are biased toward the open firing jaw position;

the piston is (i) arranged in the non-firing piston position to hold the jaws in the closed non-firing jaw position against a jaw bias and (ii) arranged in the firing piston position to enable the jaws to move to the open firing jaw position in response to the jaw bias;

the piston is biased toward the firing piston position;

the second sear is (i) arranged in the non-firing trigger arrangement to hold the piston in the non-firing piston position against the piston bias and (ii) arranged in the firing trigger arrangement to enable the piston to move to the piston firing position in response to the piston bias; and the first sear is biased toward the non-firing trigger arrangement.

9. The trigger assembly of claim 1 further comprising:

a primary safety mechanism moveable between a primary safety-off arrangement and a primary safety-on arrangement, wherein the primary safety mechanism is (i) arranged in the primary safety-on arrangement so as to block movement of the trigger mechanism into the firing trigger arrangement and (ii) arranged in the primary safety-off arrangement so as to allow movement of the trigger mechanism into the firing trigger arrangement;

a bolt sensor moveable between a bolt-present position and a bolt-absent position and biased toward the bolt-absent position, the bolt sensor being arranged to remain in its bolt-absent position in response to its bias in the absence of a bolt loaded onto the crossbow and to be held in its bolt-present position against its bias by a bolt loaded onto the crossbow, the bolt sensor being arranged in its bolt-absent position to hold the safety mechanism in its safety-on arrangement and arranged in its bolt-present position to allow movement of the safety mechanism into its safety-off arrangement.

10. The trigger assembly of claim 9 wherein the primary safety mechanism is (i) arranged in the primary safety-on arrangement so as to block movement of the first sear into the firing trigger arrangement and (ii) arranged in the primary safety-off arrangement so as to allow movement of the first sear into the firing trigger arrangement.

11. The trigger assembly of claim 9 further comprising a removable secondary safety mechanism arranged to be coupled to the trigger assembly in a secondary safety-on arrangement (i) so as to block movement of the primary safety mechanism from the primary safety-on arrangement to the primary safety-off arrangement or (ii) so as to block movement of the retainer from the non-firing retainer position to the firing retainer position.

* * * * *